US005785415A

United States Patent [19]

Matsumura et al.

[11] Patent Number: 5,785,415

[45] Date of Patent: Jul. 28, 1998

[54] LED DISPLAY DEVICE AND ITS ASSEMBLED STRUCTURE

[75] Inventors: Kazuhiko Matsumura, Kashihara; Kazunori Hoshi, Sirone; Katsushi Watanabe, Tubame, all of Japan

[73] Assignee: Sharp Kabushiki Kaisha, Osaka, Japan

[21] Appl. No.: 614,014

[22] Filed: Mar. 12, 1996

[30] Foreign Application Priority Data

Mar. 14, 1995 [JP] Japan ..... 7-054253
Jan. 30, 1996 [JP] Japan ..... 8-013777

[51] Int. Cl.[6] ..... F21V 21/00

[52] U.S. Cl. ..... 362/249; 362/800; 362/812

[58] Field of Search ..... 362/249, 800, 362/812, 267; 40/541, 564, 567

[56] References Cited

U.S. PATENT DOCUMENTS 5,268,828 12/1993 Miura ..... 362/800

FOREIGN PATENT DOCUMENTS 6-161360 A 7/1994 Japan .
1 479 779 7/1977 United Kingdom .
2 121 583 12/1983 United Kingdom .
2 136 623 9/1984 United Kingdom .

OTHER PUBLICATIONS

Patent Abstracts of Japan, Section E:E-1614, vol. 18, No. 531, p. 65 & JP6188460.
Patent Abstracts of Japan, Section P:P-1730, vol.18, No. 228, p. 118 & JP6019405.
Patent Abstracts of Japan, Section P:P-1726, vol. 18, No. 211, p. 156 & JP6012020.

*Primary Examiner*—Thomas M. Sember
*Attorney, Agent, or Firm*—Nixon & Vanderhye P.C.

[57] ABSTRACT

There is provided an LED display device which can improve maintenance properties accompanied by tightening and loosening of screws, and which can prevent deterioration in waterproof effect due to an over-tightening of screws in screw-fixing process. This LED display device includes a base plate having LED devices arrayed on its front surface, holes for screws bored through from front surface to rear surface, and a projecting portion formed around the holes within the rear surface so as to surround the holes, and a rubber packing placed between the projecting portion and the holes and having a thickness in its non-compressed state larger than a size of projection of the projecting portion. The screw is inserted into the hole from the front surface of the base plate, and into the hole of the chassis, whereby the base plate is fixed to the chassis. By the presence of the projecting portion, the screw packing and the rubber packing are prevented from over-compression.

12 Claims, 11 Drawing Sheets

LED DISPLAY DEVICE AND ITS ASSEMBLED STRUCTURE

BACKGROUND OF THE INVENTION

1. Field of the Invention

The present invention relates to an LED (light-emitting diode) display device in which a plurality of LEDs are arrayed in a matrix shape. More particularly, the invention relates to LED display devices, as well as their assembled structures, to be used outdoors, for example, in roads, stores, railroad stations, filling stations, and the like.

2. Description of the Prior Art

LED display devices, which have long life and high brightness, are now widely used as display devices. In particular, in outdoor places such as roads, stores, railroad stations, and filling stations, the LED display devices are more often used in terms of their usefulnesses such as high brightness, multicolorness, and a capability of motion picture display.

A conventional LED display device is described below with reference to FIGS. 12, 13, 14, and 15. As shown in FIG. 12, this LED display device comprises base plates 72 placed in rows and columns into a matrix shape on a front surface 73A of a chassis 73. The chassis 73 is box shaped, and the base plates 72 are plate shaped. Then, each base plate 72 is fixed to the chassis 73 with a plurality of fixing screws 78 inserted in the chassis 73 from the rear side of the chassis 73.

FIG. 13 shows a side view of one base plate 72. This base plate 72 has an unshown substrate embedded therein, and LED devices 71 are arrayed in a matrix shape on this substrate. Also, a drive board 75 is fixed on a rear surface 72B of the base plate 72. This drive board 75 has a drive circuit 74 for the LED devices 71, and others. Then, the base plate 72 is fixed to the chassis 73 with the fixing screws 78 in such a way that the drive board 75 is inserted into a window 73C of the chassis 73. In addition, reference numeral 76 denotes lead pins of the LED devices 71, for electrically connecting the substrate on which the LED devices 71 are mounted in a matrix shape, and the drive board 75 to each other.

The LED display device shown in FIG. 12 is used, for example, for signboards of stores. Although not shown, a control box, power supply, and the like for the base plates 72 are contained in the chassis 73.

FIG. 14 shows the fixing structure of the base plate 72 and the chassis 73. To the chassis 73 serving as an enclosure, the base plate 72 is fixed with the fixing screw 78. The fixing screw 78 is inserted into a through hole 76 from the rear surface 73B of the chassis 73 via a washer 77, so as to be screwed to an insert nut 80 inserted into the base plate 72. Further, an elastic member 81 is sandwiched between the base plate 72 and the chassis 73 in a region outer than the fixing screw 78. This elastic member 81 is fixed by being fitted into a peripheral recess 72C which is formed on the rear surface 72B of the base plate 72 so as to surround the outer side of the nut 80. Also, the elastic member 81 extends in a ring shape along the outer edge of the chassis 73 and the outer edge of the base plate 72.

This ring-shaped elastic member 81 plays a role of preventing external water such as rain water from penetrating inward between the chassis 73 and the base plate 72.

In this arrangement, since the base plate 72 is fixed to the chassis 73 with the fixing screws 78 as described above, the magnitude of the tightening torque for the fixing screws 78 is controlled principally in their production process. The magnitude of this tightening torque is, for example, 60 to 70 Ncm or so.

Unfortunately, when the LED display device is cared for maintenance by the user himself or herself, it is necessary for the user to first loosen and remove the fixing screw 78 and then tighten the fixing screw 78 again. In this process, if the user has tightened the fixing screw 78 too much, there arises a problem that the ring-shaped elastic member 81 acts as a loading member, causing a portion 83 of the base plate 72 near its screwing portion to be deformed oblique as shown in FIG. 15. In this case, the waterproof effect of the ring-shaped elastic member 81 is reduced, resulting in a deterioration of the reliability of the LED display device as a whole.

Also, as shown in FIG. 12 or 13, in this LED display device, there is a need of loosening or tightening the fixing screws 78 from the rear side of the chassis 73 during maintenance or during replacement of faulty parts. This leads to another problem of poor workability.

SUMMARY OF THE INVENTION

The object of the present invention is therefore to provide a high reliability LED display device, as well as its assembled structure, which allows an improvement of serviceability in the processes of tightening and loosening the screws, and which can prevent deterioration of the waterproof effect due to an over-tightening of the screws during screw fixing process.

In order to achieve the aforementioned object, according to a first aspect of the present invention, there is provided an LED display device comprising:

a base plate having a plurality of holes through which screws are inserted so as to pass through the base plate from its front surface to its rear surface, and a projecting portion provided at least around the holes on the rear surface;

a plurality of LED devices arrayed in a matrix shape on the front surface of the base plate; and ring-shaped elastic members placed on the rear surface so as to be positioned between the projecting portion and the holes, and to surround the holes;

wherein a height of the ring-shaped elastic members in their non-compressed state is higher than a height of the projecting portion from the rear surface.

According to this invention, with the rear surface of the base plate opposed to the fitting surface of the chassis, the ring-shaped elastic member is applied to the fitting surface of the chassis. Next, the screws are inserted into the holes for the screws from the front surface of the base plate. Then, the screws are screwed into, for example, a threaded hole provided on the chassis, or tightened with a nut, whereby the base plate is fixed to the chassis.

As seen above, according to this invention, the base plate can be fitted to or removed from the chassis by tightening or loosening the screw from the front side (light-emitting side) of the base plate. Accordingly, the maintenance and inspection by the user is simplified.

The ring-shaped elastic member is sandwiched and compressed between the fitting surface of the chassis and the rear surface of the base plate, thus serving a role of preventing rain water from penetrating between the fitting surface of the chassis and the rear surface of the base plate through the hole for the screw of the base plate.

Before the screw is tightened, the ring-shaped elastic member gets out upward of the projecting portion. However, as the screw is tightened more and more, the ring-shaped elastic member gets pinched between the rear surface of the base plate and the fitting surface of the chassis, and thereby compressed gradually. Then, as the screw is further tightened, the projecting portion comes into contact with the fitting surface of the chassis, so that the ring-shaped elastic member becomes flush with the projecting portion. In this state, even if the screw is further tightened, the ring-shaped elastic member will not be compressed any more because the projecting portion is in contact with the fitting surface of the chassis. That is, the ring-shaped elastic member stops being compressed. Accordingly, the presence of the projecting portion prevents the ring-shaped elastic member from being over-compressed and therefore from being broken when the screw is tightened.

Also, if a ring-shaped elastic member is provided on the outer or inner periphery of a plurality of screws, then the pressure of screw tightening will not apply to only the ring-shaped elastic member, eliminating the possibility that the ring-shaped elastic member acts as a forcing member to cause the near portion of screwing portion of a region as described to be deformed oblique.

When the screw is tightened, the projecting portion functions as a stopper for the chassis, preventing the ring-shaped elastic member from being excessively compressed. Thus, it is permitted to perform the screw tightening with a more or less large torque. Accordingly, for example, the maintenance operator on the user side can be reduced in burden.

Also, in an embodiment, the projecting portion is formed so as to extend from around the holes for the screws over the entire perimeter of the rear surface of the base plate.

Therefore, according to this embodiment, since the projecting portion supports the fitting portion of the chassis over the entire perimeter of the rear surface of the base plate, the base plate is fixed stably to this fitting surface.

Also, in an embodiment, the projecting portion is formed integrally with the base plate.

According to this embodiment, it is no longer necessary to work for fixing the projecting portion to the base plate, for example, with adhesives. Furthermore, by virtue of the integral formation, even if a relatively large torque is applied to the projecting portion, the projecting portion itself will not easily deform or break so that a high reliability can be ensured.

In a second aspect of the present invention, there is provided an assembled structure of an LED display device, comprising:

the LED display device;

a chassis having a fitting hole bored in a fitting surface; and screws;

wherein the fitting surface of the chassis is opposed to the rear surface of the base plate, end portions of the screws are inserted through the holes for the screws of the base plate from the front surface of the base plate so as to project from the rear surface of the base plate in such a way that the fitting surface and the rear surface compress the ring-shaped elastic member until the fitting surface comes into contact with the projecting portion, the end portions of the screws are fixedly fitted to the chassis, and wherein the base plate is fitted to the chassis.

According to this invention, since the screw is tightened from the front surface side (light-emitting surface side) of the LED display device, the LED display device can be removed from the chassis, as it is, only by loosening the screws from the front surface side for internal inspections at an eruption of fault or the like. Accordingly, the LED display device is simple to service and inspect and easy to handle.

Also, since the ring-shaped elastic member serving for waterproofing the screws is placed on the rear surface of the base plate, it is permitted that only the washer is placed under the screw head. Accordingly, a twist-and-break due to the contact between the washer and the rubber packing during the screw tightening process can be prevented.

In an embodiment, a ring-shaped perimeter-side elastic member is disposed on a peripheral portion of the rear surface of the base plate outside the projecting portion of the base plate so as to surround the projecting portion, and wherein the ring-shaped elastic member and the ring-shaped perimeter-side elastic member are sandwiched between the rear surface of the base plate and the fitting surface of the chassis so as to be compressed.

With the above arrangement, because a ring-shaped perimeter-side elastic member surrounds the projecting portion on the rear surface of the base plate, the projecting portion functions as a stopper that prevents the perimeter-side elastic member from being over-compressed by the fitting surface of the chassis. Accordingly, in this case, the perimeter-side elastic member is prevented from being damaged due to over-compression, and this perimeter-side elastic member functions to prevent rain water from penetrating through between the base plate and the chassis, with reliability. Furthermore, since the perimeter-side elastic member is prevented from over-compression by virtue of the projecting portion, the base plate and the chassis sandwiching this perimeter-side elastic member can be prevented from deformation.

Further, a ring-shaped perimeter-side elastic member for waterproofing between the rear surface of the base plate and the fitting surface of the chassis and the ring-shaped elastic member for waterproofing the screws are placed on the surface opposite to the LED light-emitting surface, so that irradiation of sunlight can be avoided during daytime. Accordingly, both the ring-shaped elastic member and the ring-shaped perimeter-side elastic member can be prevented from deterioration in material. Thus, the durability can be improved so that a high reliability can be obtained.

In a third aspect of the present invention, there is provided an LED display device comprising:

a base plate having a plurality of holes through which screws are inserted so as to pass through the base plate from its front surface to its rear surface;

a plurality of LED devices arrayed in a matrix shape on the front surface of the base plate; and a ring-shaped elastic member placed on the rear surface so as to be surrounded by the plurality of screw holes of the base plate.

According to this invention, the base plate can be fixed to the chassis by inserting the screw into the hole from the front surface of the base plate, applying the front surface of the chassis to the rear surface of the base plate, and by fitting the screw into the screw hole of the chassis. Therefore, according to this invention, the base plate can be fitted to the chassis only by a screw-tightening operation exerted from the front surface of the base plate, and besides, the base plate can be removed from the chassis only by a screw-loosening operation exerted from the front surface of the base plate. Accordingly, the maintenance and inspection by the user can be simplified and facilitated.

Also, according to this invention, the ring-shaped elastic member fitted to the rear surface of the base plate serves a role of preventing water (e.g. rain water) from penetrating through between the base plate and the chassis. This ring-shaped elastic member is fixed to the rear surface of the base plate so as to be surrounded by the holes for the screws. That is, a top portion of the ring-shaped elastic member is coupled to the chassis with the screw inserted into the screw hole. Accordingly, even if an over-tightening of the screw inserted into the screw hole has occurred, the rear surface of the base plate and the fitting surface of the chassis become generally flush with each other by the projecting portion of the ring-shaped elastic member being compressed. Thus, the possibility that the ring-shaped elastic member functions as a loading member such that the outer portion of the base plate is distorted, as would occur in the prior art structure, can be prevented. That is, when an over-tightening of the screw inserted into the screw hole has occurred, the portion of the base plate outer than the ring-shaped elastic member can be prevented from being distorted by compression stress of the ring-shaped elastic member. Therefore, according to this invention, deterioration of the waterproof effect can be prevented even if the screw is over-tightened in the fixing process to the chassis by screws. Thus, the reliability can be improved.

Also, since the ring-shaped elastic member is placed on the inner periphery of a plurality of screw holes, the distortion of the outer portion of the base plate can be suppressed to less, unlike the prior art, even if a projecting portion is left outside more or less. Therefore, according to this invention, during the fixing process to the chassis by screws, the possibility that the waterproof effect may deteriorate even if the screw is over-tightened can be prevented. Thus, the reliability can be improved.

Also, in an embodiment, the ring-shaped elastic member is partially buried in the base plate in such a way that an upper portion of the ring-shaped elastic member is projected from the rear surface of the base plate.

According to this embodiment, the ring-shaped elastic member is securely fixed to the base plate. Besides, by adjusting the burying size of the ring-shaped elastic member into the base plate, the amount of compression of the ring-shaped elastic member in the screw tightening process can be set to a desired one. Accordingly, the ring-shaped elastic member can be prevented from being deformed to an excessive amount and thereby damaged, and moreover the base plate can be prevented from being deformed due to an over-compression of the ring-shaped elastic member.

In a fourth aspect of the present invention, there is provided an assembled structure of an LED display device, comprising:

the LED display device;

a chassis having a fitting hole bored in a fitting surface; and screws;

wherein the fitting surface of the chassis is opposed to the rear surface of the base plate, an end portion of the screws are inserted through the holes for the screws of the base plate from the front surface of the base plate so as to project from the rear surface of the base plate, in such a way that the fitting surface and the rear surface compress the ring-shaped elastic member, the end portions of the screws are fixedly fitted to the chassis, and wherein the base plate is fitted to the chassis.

According to this assembled structure of an LED display device, the following advantages (1) and (2) can be produced:

(1) The base plate can be fitted to and removed from the chassis by using the screws inserted into the holes for the screws from the front surface of the base plate. Accordingly, the maintenance and inspection by the user can be simplified and facilitated.

(2) Since the ring-shaped elastic member is fitted to the rear surface of the base plate so as to be surrounded by the holes for the screws, the portion of the base plate outer than the ring-shaped elastic member can be prevented from being distorted even when the ring-shaped elastic member is over-compressed by the screw being tightened too much. This is because the portion of the base plate outer than the ring-shaped elastic member is coupled to the chassis by the screws inserted into the holes.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The present invention is described hereinbelow in more detail based on embodiments thereof illustrated in the accompanying drawings.

(First Embodiment)

Figure 1:
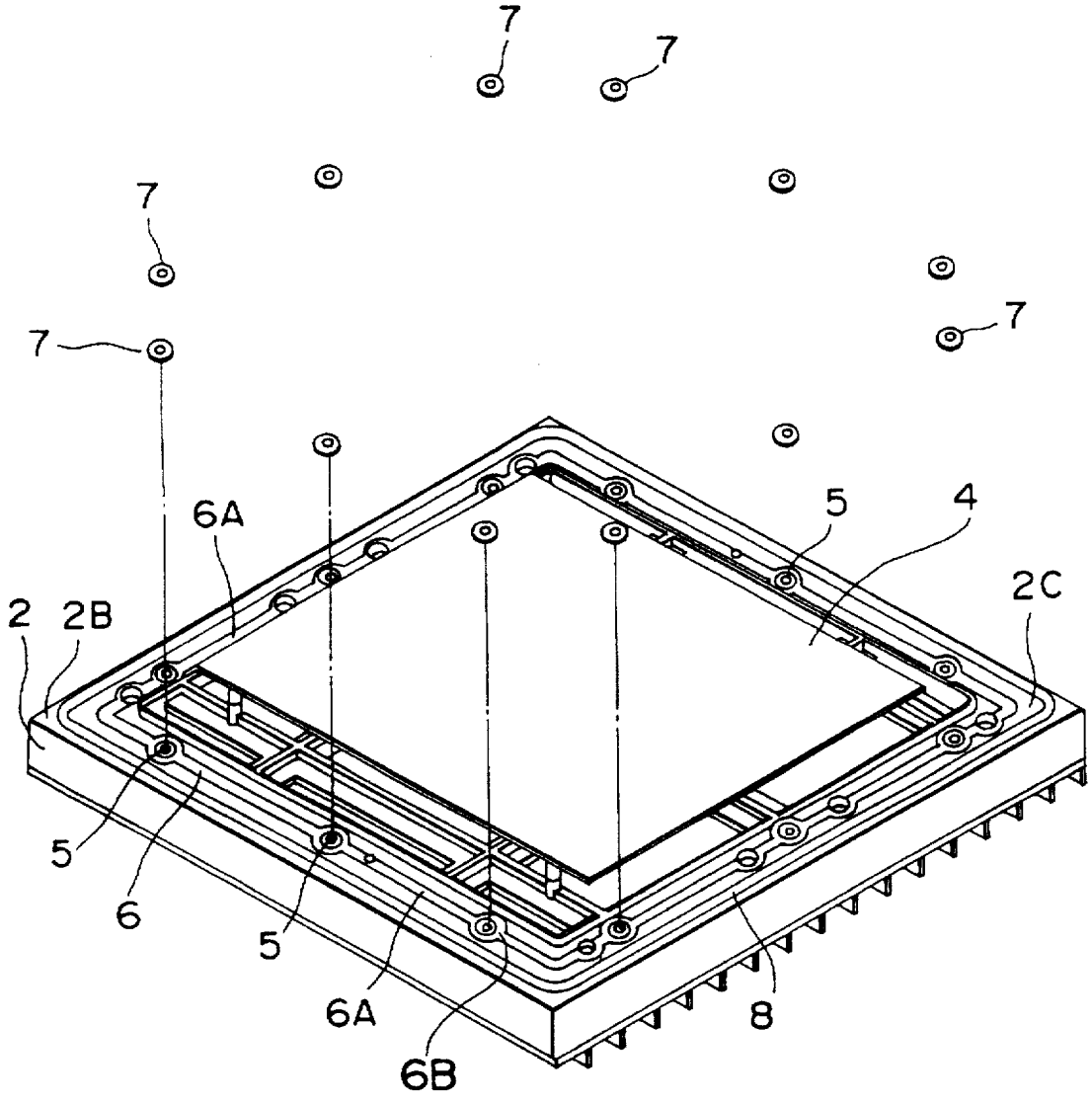
FIG. 1 is a rear-surface side perspective view of a first embodiment of the LED display device of the present invention.
Figure 2:
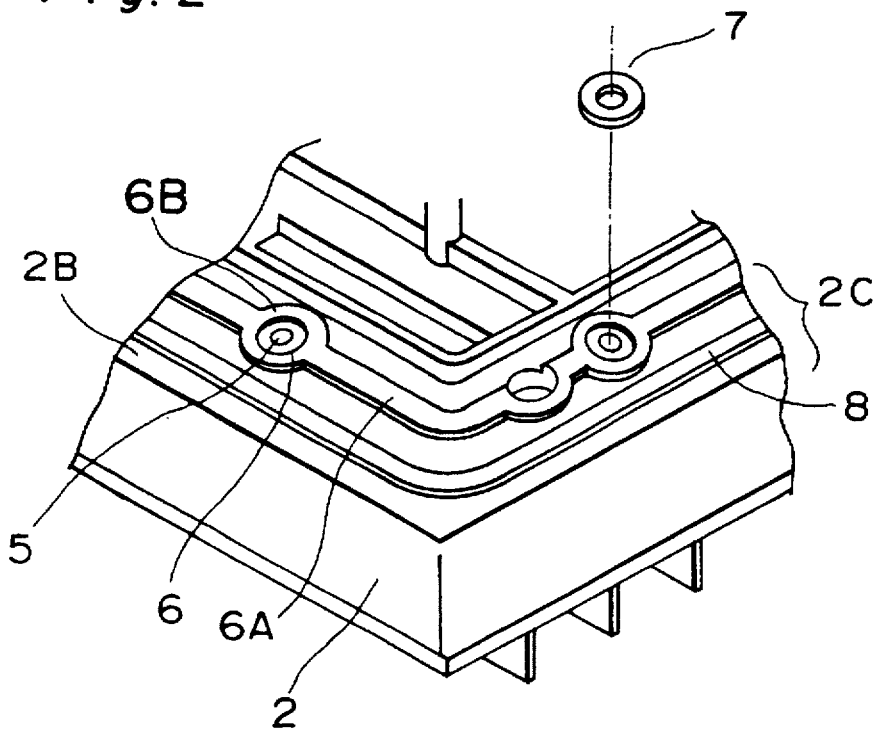
FIG. 2 is a partly enlarged view of FIG. 1.
Figure 3:
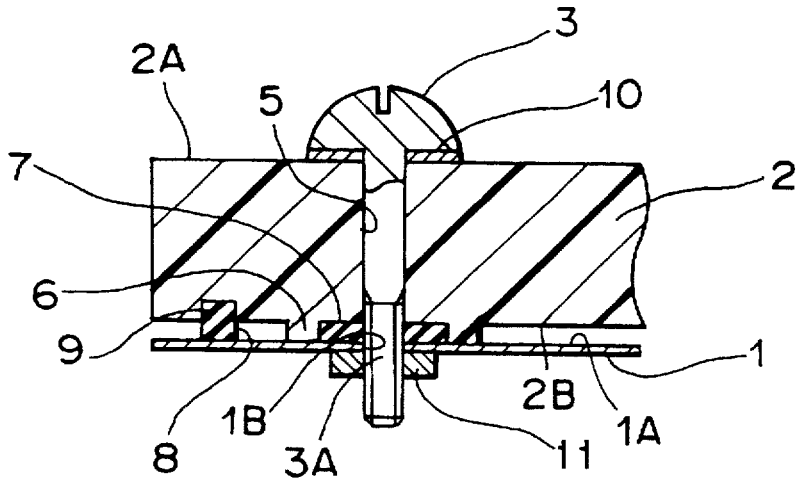
FIG. 3 is a partly sectional view for explaining the assembled structure of the first embodiment.
Figure 4:
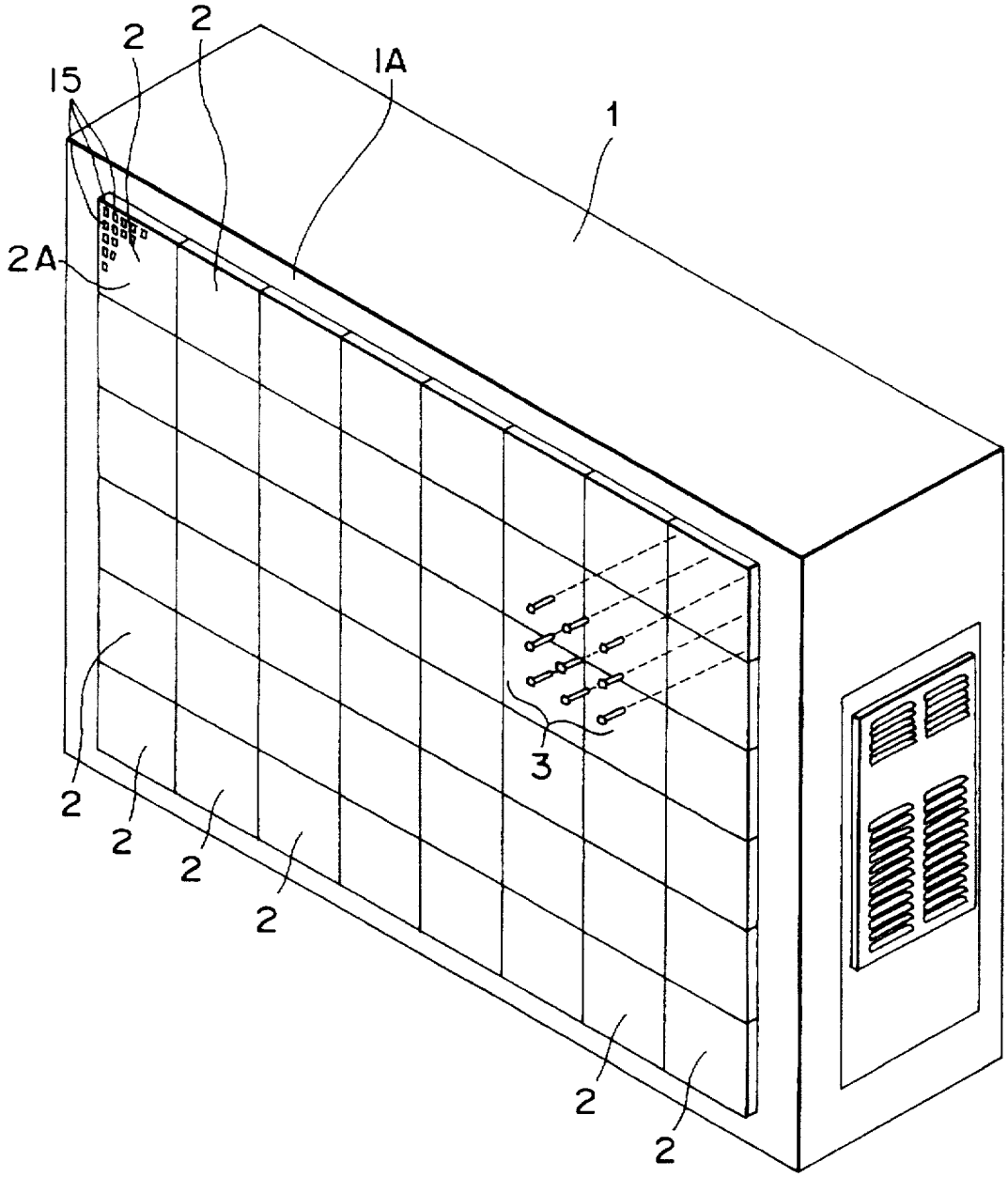
FIG. 4 is a perspective view showing the state in which display devices of the first embodiment are arrayed in a matrix shape and fixed to the chassis as it is.

A first embodiment of the present invention is described with reference to FIGS. 1 to 4. FIG. 1 is a perspective view of the rear surface side (a surface on a side opposite to a light-emitting surface side) of an LED display device of this embodiment. FIG. 2 is a partly enlarged view of FIG. 1, and FIG. 3 is a partly enlarged sectional view showing the screw fixing structure that the LED display device of this embodiment is fixed to a chassis. Also, FIG. 4 shows a chassis 1, and a plurality of base plates 2 arrayed in rows and columns and fixed on a front surface 1A of the chassis 1. As shown in FIG. 4, the base plates 2 are fixed to the chassis 1 with a plurality of screws 3 that are to be screwed from the front side of the chassis 1, i.e., the display side of the base plates 2. These base plates 2 are made mainly from polycarbonate. Further, a plurality of LED devices 15 are arranged in a matrix shape on a front surface 2A of the base plates 2.

In the LED display device of this embodiment, as shown in FIGS. 1 and 2, a stopper 6 is provided projectionally on the rear surface 2B side of the base plate 2. The part 6B of the stopper 6 surrounds holes 5 for the screws 3. This stopper 6 also has a perimetric extended portion 6A which is extendedly formed from the part 6B so as to surround the entire perimeter of the rear surface 2B of the base plate 2. The stopper 6 serves as a projecting portion. In addition, reference numeral 4 denotes a drive board, which is fixed to the rear surface 2B at the center of the base plate 2.

Although the stopper 6 is formed integrally with the base plate 2 in this embodiment, the stopper 6 may be formed separately from the base plate 2 and bonded with the base plate 2.

Packings 7 for a screw which are ring-formed so as to surround the holes 5 respectively are so arranged as to be positioned between the screw holes 5 and the stopper 6 on the rear surface 2B. The packings 7 serve as a ring-shaped elastic member. As the material of these screw packings 7, whereas silicone resin has been used in this embodiment, the same material as those of conventional rubber packings may be used. In this connection, the height of the screw packings 7 in their non-compressed state is set to a specified length higher than that of the stopper 6. Also, a perimetric rubber packing 8 is fixed to a peripheral portion 2C of the base plate 2 outer than the stopper 6. The perimetric rubber packing 8 serves as a ring-shaped perimeter-side elastic member. As shown in FIG. 3, the perimetric rubber packing 8 is fitted into a recess 9 formed on the rear surface 2B of the base plate 2. This perimetric rubber packing 8 is made from silicone resin and, as shown in FIG. 1, formed into a square looped shape surrounding the four-side perimeter of the stopper 6. Also, the perimetric rubber packing 8 is set to the same height as the ring-shaped screw packings 7. More specifically, as shown in FIG. 11, while the stopper 6 is 0.65 mm high, the screw packings 7 are 1.00 mm high in non-compressed state.

When the base plate 2 of the LED display device having the above structure is fixed by screws to the chassis 1, the result is as shown in FIG. 3. The screw 3 is inserted into the screw hole 5 from the front surface 2A of the base plate 2 via a washer 10, and projected out by being passed through the screw packing 7 and a through hole 1B of the chassis 1. Then, a nut 11 is screwed in a thread portion 3A of the screw 3. The mating of the nut 11 and the screw 3 makes the base plate 2 fixed to the chassis 1. At the same time, the perimeter-side rubber packing 8 and the screw packing 7 are sandwiched between the rear surface 2B of the base plate 2 and the front surface 1A of the chassis 1, so as to be compressed by a specified extent. As a result, the perimeter-side rubber packing 8 is enabled to prevent rain water from penetrating through between the edge of the front surface i.e. fitting surface 1A of the chassis 1 and the edge of the rear surface 2B of the base plate 2. Also, the screw packing 7 is enabled to prevent rain water from penetrating through the screw hole 5 into between the base plate 2 and the chassis 1.

According to this first embodiment, the base plate 2 can be fixed to the chassis 1 by screwing from the front surface 2A of the base plate 2. This leads to good workability and facilitated maintenance and inspection.

Figure 11:
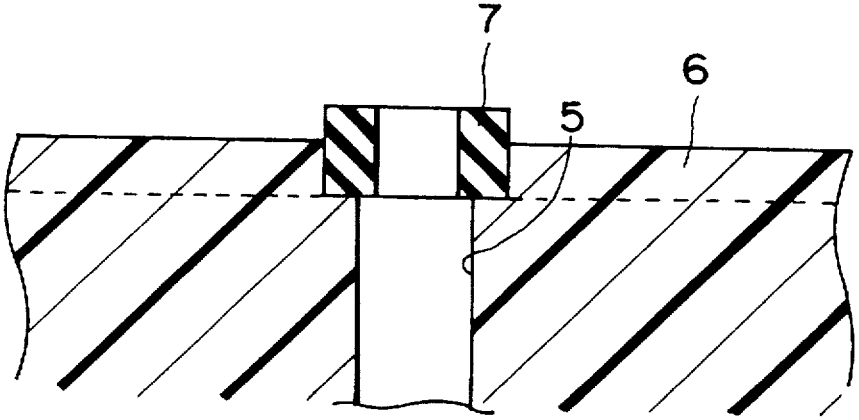
FIG. 11 is a sectional view showing the state in which an elastic member is fitted into a projecting portion in the first embodiment.
Figure 12:
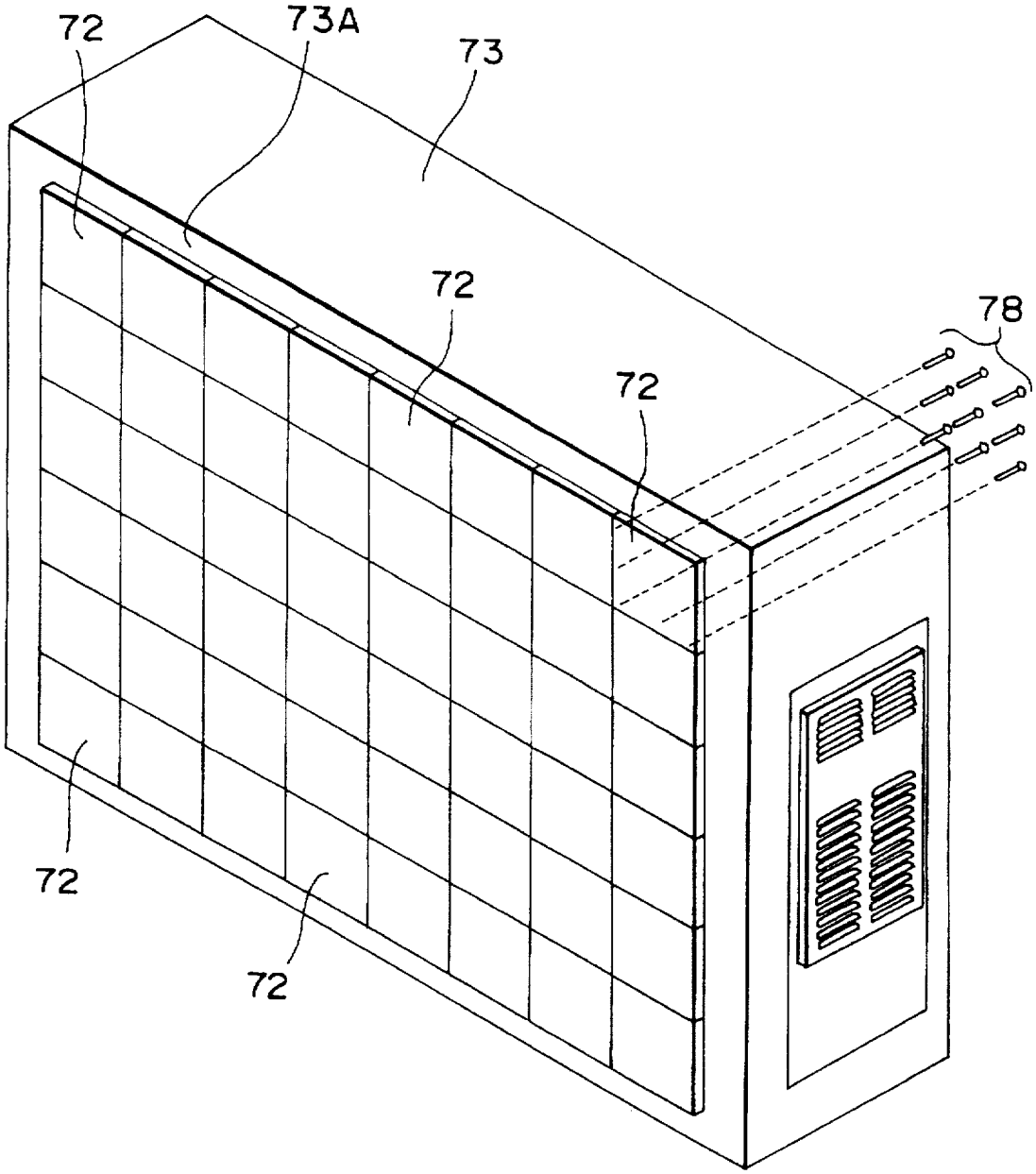
Fig. 12 PRIOR ART
FIG. 12 is a perspective view showing the assembled structure of a conventional LED display device.
Figure 13:
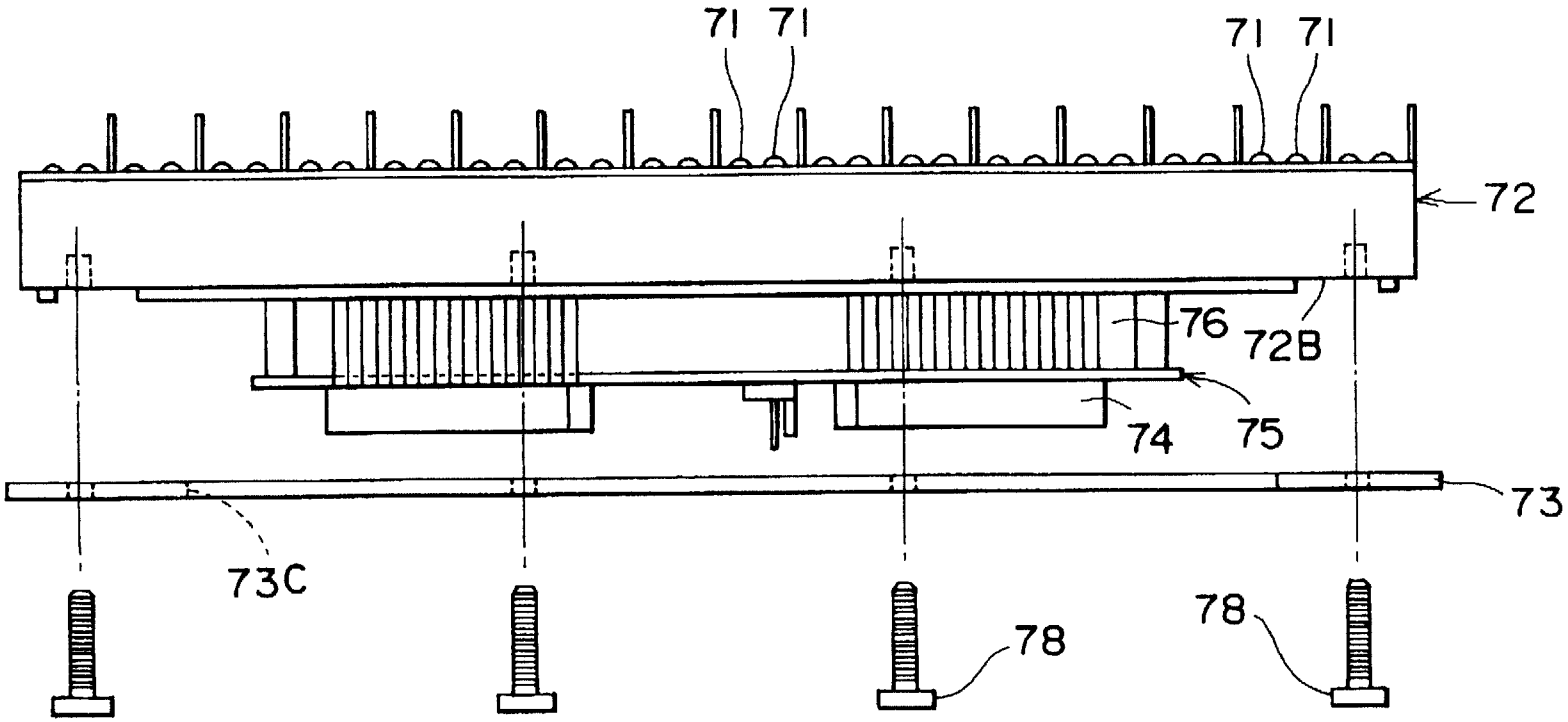
Fig. 13 PRIOR ART
FIG. 13 is a side view showing the assembled structure of the conventional LED display device.
Figure 14:
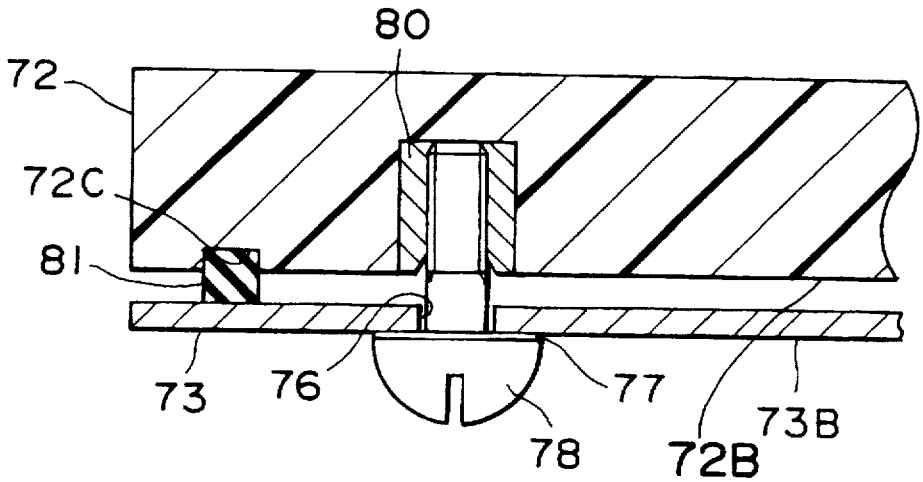
Fig. 14 PRIOR ART
FIG. 14 is a partly sectional view for explaining the assembled structure of the conventional LED display device.
Figure 15:
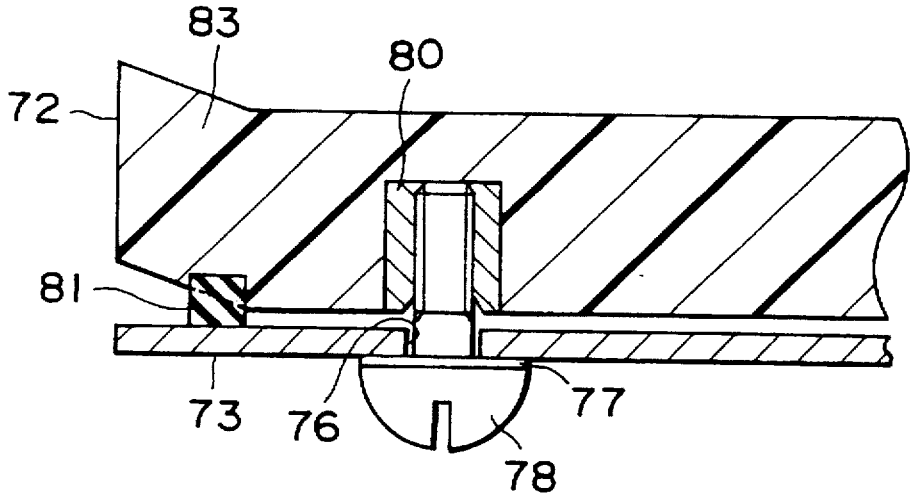
Fig. 15 PRIOR ART
FIG. 15 is a sectional view showing the state in which an end portion of a base plate is distorted in the assembled structure of the conventional LED display device.

As shown in FIG. 11, in a non-compressed state of the screw waterproof packing 7 before tightening the screw 3, the screw waterproof packing 7 is projected a specified length outer than the stopper 6. Then, as the screw 3 is tightened, the screw packing 7 is gradually compressed, approaching the state shown in FIG. 3. At the same time, the perimeter-side rubber packing 8 is also compressed, approaching the state shown in FIG. 3. Then, as the screw 3 is further tightened, the screw packing 7 becomes the same height as the stopper 6, as shown in FIG. 3. After the screw packing 7 and the stopper 6 have got equal in height, further tightening the screw 3 would not cause the ring-shaped screw packing 7 or the perimeter-side rubber packing 8 to be compressed any more, because the chassis 1 is in contact with the stopper 6.

Therefore, according to this embodiment, the screw packing 7 and the perimeter-side rubber packing 8 can be prevented from being over-compressed by virtue of the stopper function of the stopper 6. As a result, the screw packing 7 can be prevented from being thinned and broken out. Also, the perimeter-side rubber packing 8 does not serve as a member pressing the base plate 2, so that part of the base plate 2 near the rubber packing 8 can be prevented from being deformed oblique. Furthermore, also when a torque slightly larger than a specified torque is exerted for the screwing, the stopper 6 makes contact with the chassis 1, preventing the rubber packing 7 from being excessively compressed. Accordingly, while the screw packing 7 can be prevented from being broken out, the base plate 2 can be prevented from being deformed. As a result, the maintenance work by the user can be facilitated so that the user is less burdened for maintenance work.

In this embodiment, since no rubber packing but only the washer 10 is disposed under the head of the screw 3, there is a possibility that water from external may penetrate through the washer 10 up to the screw hole 5. However, the rubber packing 7 for the screw prevents the water that has reached the screw hole 5, from penetrating to between the base plate 2 and the chassis 1. Accordingly, the inner part of the rear surface 2B of the base plates 2 of the LED display device, where contact with water would matter, is fully waterproofed. Thus, the possibility of any trouble can be eliminated.

Also, the LED display device is also waterproofed by the perimeter-side rubber packing 8 in terms of water penetration sideways (i.e., through the clearance between the edge of the rear surface 2B of the base plate 2 and the edge of the front surface 1A of the chassis 1).

Further, in this embodiment, only the washer 10 is disposed under the head of the screw 3 as described before. Therefore, there will be no occurrence of a problem that when a rubber packing and a washer are in contact with each other under the head of a screw, they rotate while being tightened by a screw tightening so that the rubber packing may be twisted and cut due to the friction between them.

Further, since the screw packing 7 is placed on the rear surface 2B on a side opposite to the LED light-emitting surface, irradiation of sunlight during daytime can be avoided. Accordingly, the packing 7 can be prevented from deterioration, so that a high reliability can be attained.

As described above, the LED display device of this embodiment adopts a structure for the screw 7 to be threaded from the front surface 2A of the base plate 2, which is on the light-emitting surface side. Therefore, the base plates 2 can be easily fitted to and removed from the chassis 1. As a result, the worker can be reduced in burden for maintenance. Also, the presence of the stopper 6 prevents the rubber packings 7 and 8 from twist-and-cut or extreme deformation, ensuring a reliable waterproof effect. Furthermore, the screw packing 7 can be prevented from deterioration due to irradiation of sunlight or the like.

In addition, in this first embodiment, the stopper 6 has been formed on the rear surface 2B side of the base plate 2 of the LED display device. However, it is also possible that a stopper (not shown) is formed under the head of the screw 3 on the front surface 2A of the base plates 2 of the LED display device, where a packing (not shown) is disposed within the stopper so as to surround the hole 5. In this case also, turning the screw 3 from the front surface 2A side of the base plate 2 allows the base plate 2 to be removed from the chassis 1, so that the user maintenance can be facilitated. However, in this case, the washer 10 and the packing for the screw 3 come into contact with each other, so that the screw packing may be twisted and cut off because of the relative rotation of the washer 10 and the screw packing during the tightening process. Consequently, as shown in FIGS. 1 to 3, the stopper 6 is desirably provided on the rear surface 2B of the base plate 2.

Also, in the embodiment of FIG. 1, the stopper 6 has been formed on the entire perimeter of the rear surface 2B of the base plates 2 of the LED display device. However, a stopper may also be formed only around the screw hole 5 of the rear surface 2B. In this case also, over-compression of the screw packing 7 and deformation of the base plate 2 due to the tightening of the screw can be prevented. In this case, however, the stopper's function of supporting the chassis 1 would deteriorate to a slight extent as compared with the embodiment of FIG. 1, so that the effect of preventing the perimeter-side packing 8's over-compression would slightly deteriorate. Accordingly, there is a possibility that the waterproof effect of the perimeter-side packing 8 may deteriorate to a slight extent.

[Second Embodiment]

Figure 5:
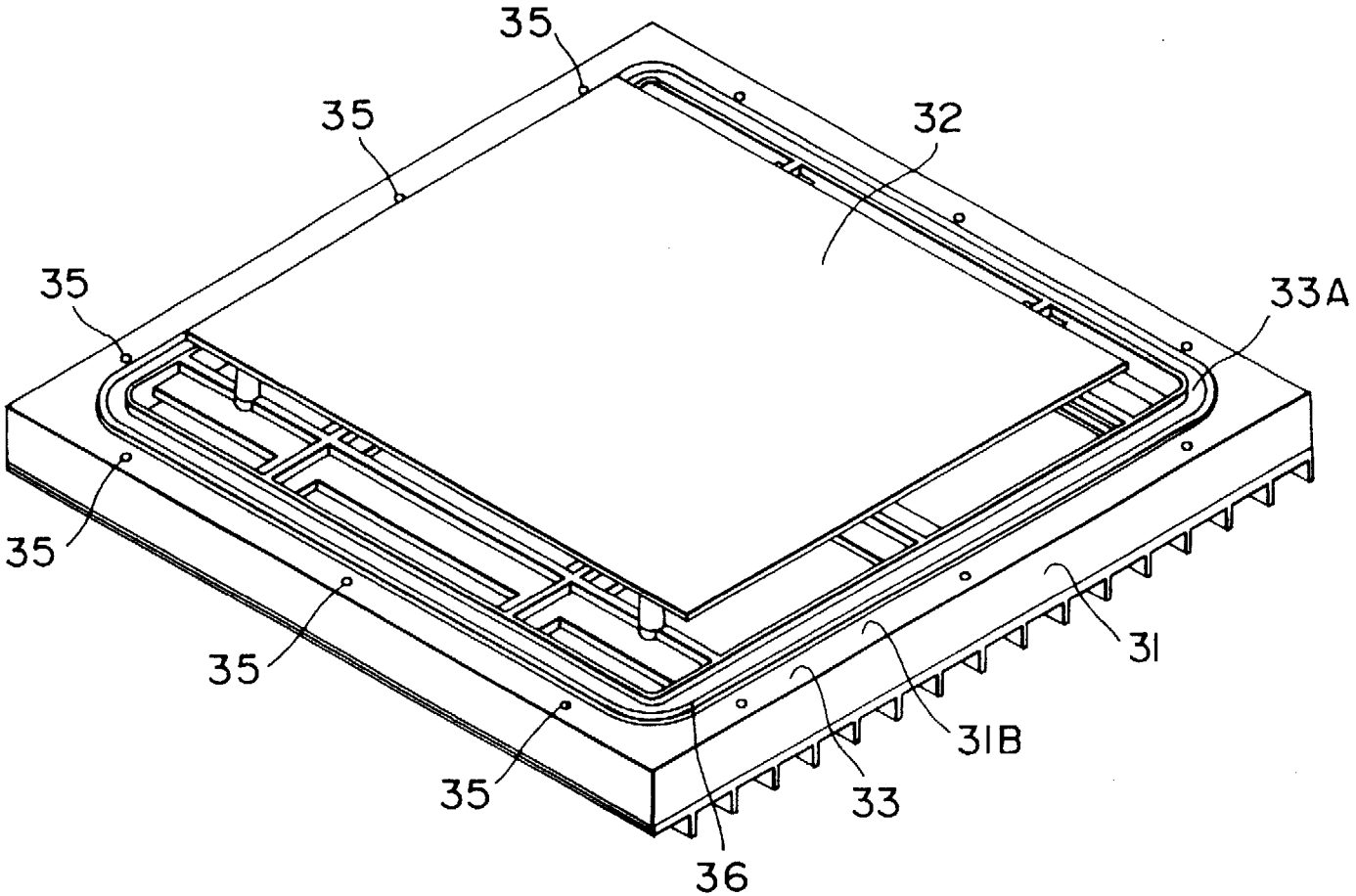
FIG. 5 is a rear-surface perspective view of a second embodiment of the LED display device of the present invention.
Figure 6:
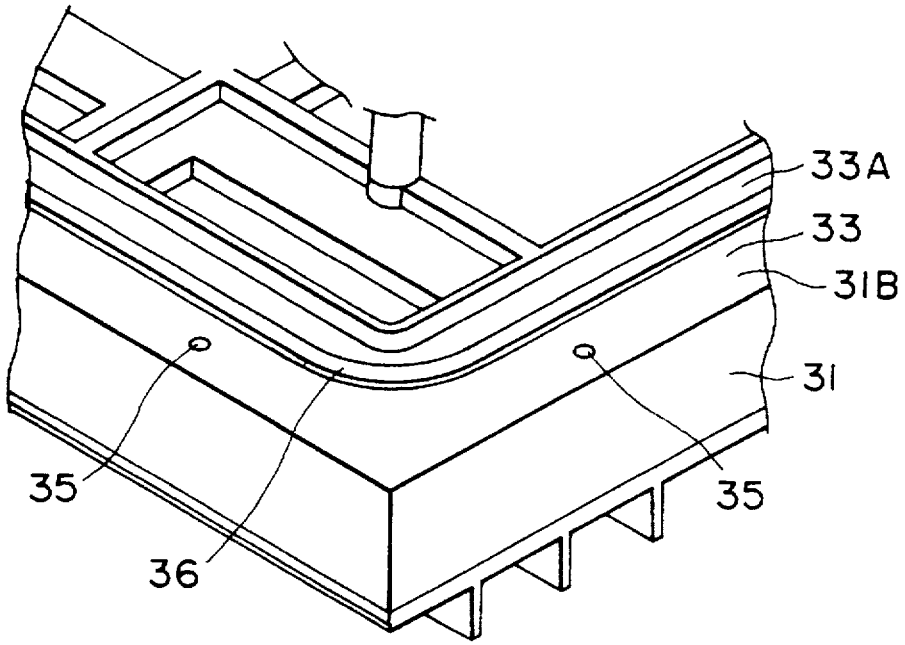
FIG. 6 is a partly enlarged view of FIG. 5.

Next, FIG. 5 shows a perspective view of the rear surface (a surface on a side opposite to the light-emitting surface) of the LED display device according to a second embodiment of the present invention. FIG. 6 shows a perspective view of a corner portion of the rear surface of the LED display device. Base plates 31 of this second embodiment are similar to those of the foregoing first embodiment as shown in FIG. 4, in that they are arrayed in rows and columns on the front surface 1A of the chassis 1.

Figure 10:
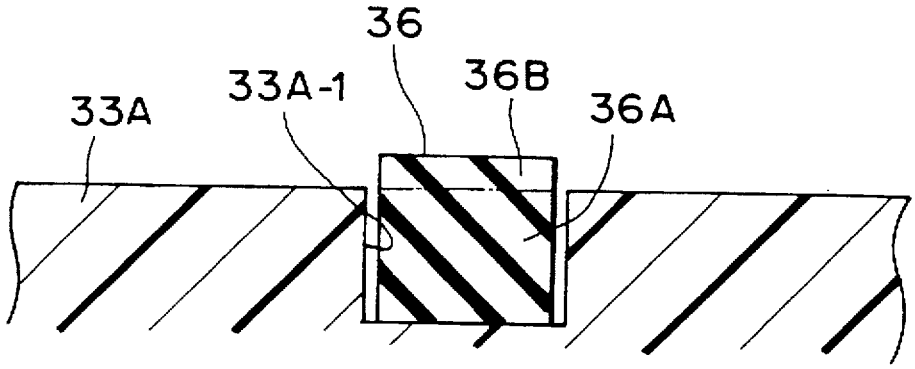
FIG. 10 is a sectional view showing the state in which an elastic member is buried in the base plate in the second embodiment.

As shown in FIG. 5, a drive board 32 is fixed in the center of a rear surface 31B of the base plate 31 made of polycarbonate. Then, in a rear-surface peripheral portion 33 of the base plate 31 outer than the drive board 32, three holes 35 for screws for each of the four edge sides of the peripheral portion 33 are formed at generally equal intervals. Also, a generally square, ring-shaped elastic member 36 made from silicone resin and formed so as to surround the drive board 32 is fixed in a portion 33A of the peripheral portion 33 inner than the screw holes 35. As shown in FIG. 10, this ring-shaped elastic member 36 has an approximately 9/10 portion 36A of it fitted and fixed to a recess 33A-1 formed in the portion 33A, and an approximately 1/10 portion 36B of it projected from the surface of the portion 33A. In more detail, it has been set, for example, that the depth of the recess 33A-1 is 2.65 mm, the cross section of the elastic member 36 is formed into a 3 mm square shape, the thickness of the portion 36A is 2.65 mm, and that the thickness of the portion 36B is 0.35 mm.

Figure 8:
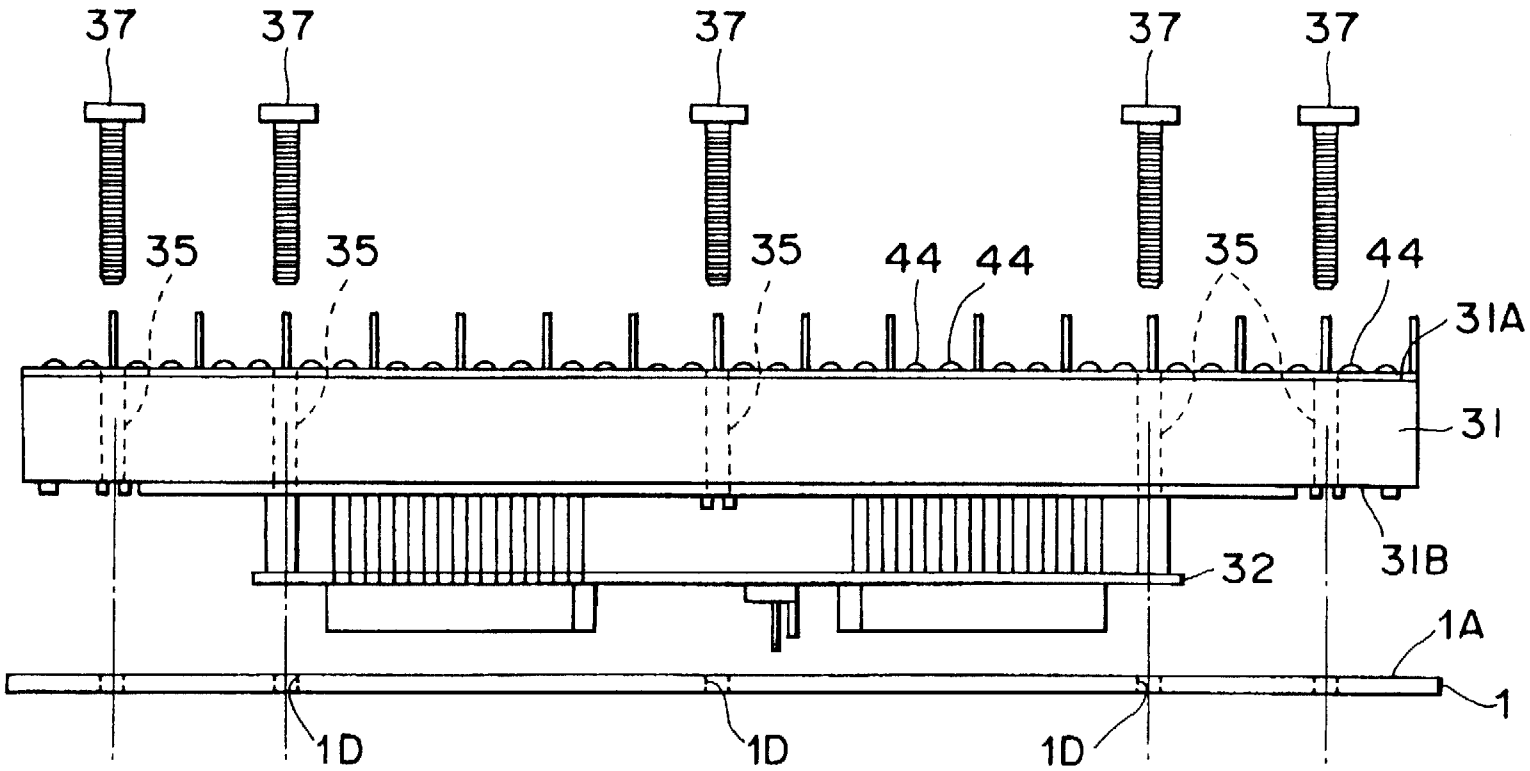
FIG. 8 is a side view for explaining the assembled structure of the second embodiment.
Figure 9:
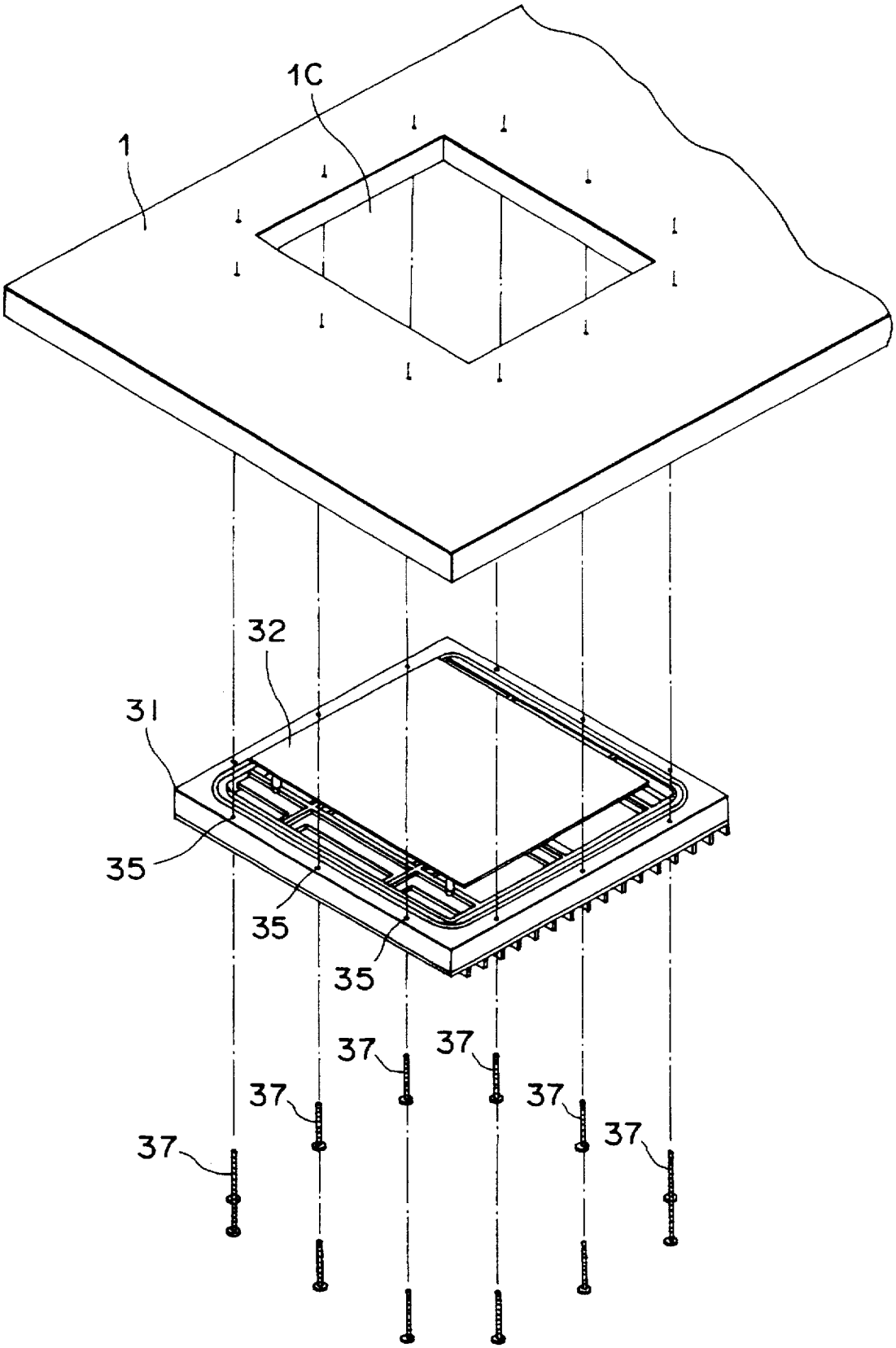
FIG. 9 is a perspective view for explaining the assembled structure of the second embodiment.

As shown in FIG. 8, a plurality of LED devices 44 are arrayed in a matrix shape on a front surface 31A of the base plate 31. Meanwhile, the drive board 32 is fixed on the rear surface 31B of the base plate 31. Then, this base plate 31 is fixed to the front surface 1A of the chassis 1 with a plurality of screws 37 inserted through the screw holes 35 of the front surface 31A of the base plate 31. In addition, the drive board 32 is to be fitted to a rectangular window 1C formed on the front surface 1A of the chassis 1 as shown in FIG. 9.

Figure 7:
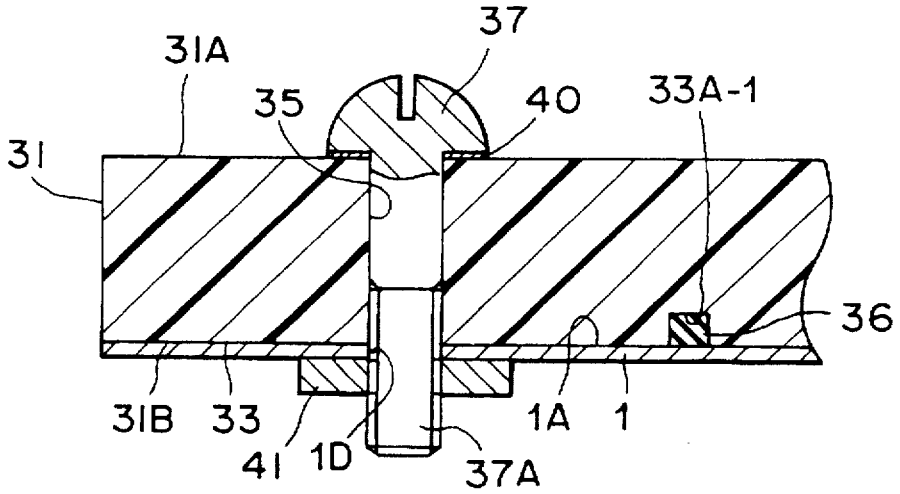
FIG. 7 is a partly sectional view for explaining the assembled structure of the second embodiment.

FIG. 7 shows a state that the base plate 31 is fixed to the chassis 1 with the screw 37. The screw 37 is inserted into the screw hole 35 from the front surface 31A of the base plate 31 via a washer 40, and a nut 41 is threaded with a screw portion 37A projected out of the rear-surface peripheral portion 33 of the base plate 31 and out of a portion of the chassis 1 with which the peripheral portion 33 makes close contact. During the process of tightening the base plate 31 to the chassis 1 with these screw 37 and nut 41, the ring-shaped elastic member 36 is gradually compressed by the chassis 1. Then, by further tightening the screw 37, the ring-shaped elastic member 36 is compressed until it becomes generally flush with the rear surface 31B of the base plate 31, thus being deformed. Now even if the screw 37 is tightened further, the ring-shaped elastic member 36 would not be deformed any more because the chassis 1 is in contact with the rear surface 31B of the base plate 31.

More specifically, as shown in FIG. 10, if the thickness of the projecting portion 36B of the ring-shaped elastic member 36 is 0.35 mm, and if the thickness of a buried portion 36A of it is 2.65 mm, then it can be generally fully prevented that the elastic stress of the ring-shaped elastic member 36 in its compressed state may cause the peripheral portion 33 of the base plate 31 to deform oblique. Also, the ring-shaped elastic member 36 can be prevented from being over-compressed, so that the elastic member 36 can be prevented from being damaged.

According to the second embodiment, the base plate 31 can be fitted to the chassis 1 only by screw-tightening operation exerted from the front surface 31A of the base plate 31, and moreover the base plate 31 can be removed from the chassis 1 only by screw-loosening operation exerted from the front surface 31A of the base plate 31. Accordingly, the maintenance and inspection by the user can be made simple and easy.

The ring-shaped elastic member 36 fitted to the rear surface 31B of the base plate 31 functions to prevent water (rain water or the like) from penetrating through between the base plate 31 and the chassis 1. This ring-shaped elastic member 36 is fitted to the rear surface 31B of the base plate 31 so as to surround its portion inner than the screw holes 35. That is, the portion of the base plate 31 outer than the ring-shaped elastic member 36 is coupled to the chassis 1 with the screws 37 inserted into the screw holes 35, respectively. Accordingly, in the event of an over-tightening of the screws 37 inserted through the screw holes 35, even if the ring-shaped elastic member 36 is over-compressed, the projecting portion of the ring-shaped elastic member 36 is compressed until the rear surface 31B of the base plate 31 and the front surface 1A of the chassis 1 becomes generally flush with each other. Thus, it can be prevented that the ring-shaped elastic member 36 acts as a loading member to cause the base plate to be distorted at its outer portion, which would be involved in the prior art structure.

In this case, since the ring-shaped elastic member 36 is placed inner than the plurality of screw holes 35, the distortion of the outer portion of the base plate 31 can be suppressed to less, unlike the prior art, even if the projecting portion of the ring-shaped elastic member 36 is left to some extent.

Accordingly, it can be prevented that the waterproof performance deteriorates due to an over-tightening of the screws 37. Thus, the reliability can be improved.

Also, as shown in FIG. 10, the ring-shaped elastic member 36 is fitted and fixed to the recess 33A-1 of the portion 33A surrounding the inner portion. Further, the extent to which the ring-shaped elastic member 36 is projected from the rear surface 31B of the base plate 31 is so set that when the front surface 1A of the chassis 1 is put into close contact with the rear surface 31B of the base plate 31, the quantity of compression of the ring-shaped elastic member 36 becomes a desired value. The desired value refers to such a value that the ring-shaped elastic member 36 will not result in any over-compression. Thus, the rear surface 31B itself of the base plate 31 can be made to serve as a stopper for the chassis 1. Accordingly, oblique deformation of part of the base plate 31 near the screwing portion as well as damage of the elastic member 36 due to over-tightening of the screw 37 can be prevented.

Further, since the ring-shaped elastic member 36 is provided on the surface 31B on a side opposite to the LED light-emitting surface, irradiation of sunlight can be avoided during daytime. Accordingly, the ring-shaped elastic member 36 can be prevented from material deterioration, so that the durability can be improved and a high reliability can be obtained.

In addition, in the second embodiment, the thickness of the projecting portion 33B of the ring-shaped elastic member 36 has been set to 0.35 mm. However, it has only to be set to such a size of projection that the edge portion of the base plate 31 will not be deformed when the elastic member 36 is compressed by the chassis 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An LED display device comprising:

a base plate having a plurality of holes through which screws may be inserted so as to pass through the base plate from a front surface to a rear surface, and a projecting portion provided at least around the holes on the rear surface and extending from said rear portion;

a plurality of LED devices arrayed in a matrix shape on the front surface of the base plate; and ring-shaped elastic members place on the rear surface so as to be positioned between the projecting portion and the holes, and to surround the holes;

wherein a height of the ring-shaped elastic members in a non-compressed state is higher than a height of the projecting portion from the rear surface.

2. The LED display device according to claim 1, wherein the projecting portion is formed so as to extend from around the holes for the screws over the entire perimeter of the rear surface of the base plate.

3. The LED display device according to claim 2, wherein the projecting portion is formed integrally with the base plate.

4. The LED display device according to claim 1, wherein the projecting portion is formed integrally with the base plate.

5. An assembled structure of an LED display device, comprising:

the LED display device according to claim 1;

a chassis having a fitting hole bored in a fitting surface; and screws;

wherein the fitting surface of the chassis is opposed to the rear surface of the base plate, end portions of the screws are inserted through the holes for the screws of the base plate from the front surface of the base plate so as to project from the rear surface of the base plate in such a way that the fitting surface and the rear surface compress the ring-shaped elastic member until the fitting surface comes into contact with the projecting portion, the end portions of the screws are fixedly fitted to the chassis, and wherein the base plate is fitted to the chassis.

6. The assembled structure of an LED display device according to claim 5, wherein a ring-shaped perimeter-side elastic member is disposed on a peripheral portion of the rear surface of the base plate outside the projecting portion of the base plate so as to surround the projecting portion, and wherein the ring-shaped elastic member and the ring-shaped perimeter-side elastic member are sandwiched between the rear surface of the base plate and the fitting surface of the chassis so as to be compressed.

7. The LED display device of claim 1, wherein said ring-shaped elastic member in its non-compressed state has a specified height greater than the height of said projecting portion such that, when said base plate is attached to a chassis, said ring-shaped elastic member is compressed by a specified extent.

8. The LED display device of claim 1, wherein said ring-shaped elastic member has a non-compressed height of approximately 1.00 millimeter and said projecting portion has a height of approximately 0.65 millimeter.

9. An LED display device comprising:

a base plate having a plurality of holes through which screws may be inserted so as to pass though the base plate from a front surface to a rear surface;

a plurality of LED devices arrayed in a matrix shape on the front surface of the base plate; and a ring-shaped elastic member placed on the rear surface so as to be surrounded by the plurality of screw holes of the base plate, wherein said ring-shaped elastic member is partially recessed in the base plate in such a way that an upper portion of the ring-shaped elastic member projects from the rear surface of the base plate.

10. The LED display device of claim 9, wherein said partially recessed ring-shaped elastic member projects from the rear surface of the base plate to an extent such that when said rear surface is attached to a chassis, the ring-shaped elastic member is compressed by a desired value.

11. The LED display device of claim 9, wherein the recessed portion of said ring-shaped elastic member is approximately 2.65 millimeters and wherein the portion of said ring-shaped elastic member which projects from said rear surface is approximately 0.35 millimeter.

12. An assembled structure of an LED display device, comprising:

the LED display device according to claim 7;

a chassis having a fitting hole bored in a fitting surface; and screws;

wherein the fitting surface of the chassis is opposed to the rear surface of the base plate, an end portion of the screws are inserted through the holes for the screws of the base plate from the front surface of the base plate so as to project from the rear surface of the base plate, in such a way that the fitting surface and the rear surface compress the ring-shaped elastic member, the end portions of the screws are fixedly fitted to the chassis, and wherein the base plate is fitted to the chassis.

* * * * *

UNITED STATES PATENT AND TRADEMARK OFFICE

CERTIFICATE OF CORRECTION

PATENT NO. : 5,785,415
DATED : July 28, 1998
INVENTOR(S) : MATSUMURA et al.

It is certified that error appears in the above-identified patent and that said Letters Patent is hereby corrected as shown below:

Cover page, [73], --Sharp Niigata Corporation, Niigata, Japan-- should be added.

Signed and Sealed this

Third Day of August, 1999

*Attest:*

*Attesting Officer*

Q. TODD DICKINSON

*Acting Commissioner of Patents and Trademarks*